United States Patent [19]

Ando et al.

[11] Patent Number: 4,669,640

[45] Date of Patent: Jun. 2, 1987

[54] SEALED GABLE TOP CARTON HAVING A MOUTHPIECE OF ONE PIECE MOLDING

[75] Inventors: Michihiro Ando, Tokyo; Ryoichi Kawajiri, Kawasaki; Hiroshi Uematsu, Tokyo, all of Japan

[73] Assignee: Dai Nippon Insatsu Kabushiki Kaisha Meiji Milk Products Company Limited, Japan

[21] Appl. No.: 747,450

[22] Filed: Jun. 21, 1985

[30] Foreign Application Priority Data

| | | | |
|---|---|---|---|
| Jun. 26, 1984 | [JP] | Japan | 59-95872[U] |
| Oct. 26, 1984 | [JP] | Japan | 59-224085 |
| Oct. 30, 1984 | [JP] | Japan | 59-164343[U] |
| Dec. 20, 1984 | [JP] | Japan | 59-193559[U] |
| Dec. 30, 1984 | [JP] | Japan | 59-201906[U] |

[51] Int. Cl.[4] ..... B65D 47/10; B65D 41/00; B65D 17/34

[52] U.S. Cl. ..... 222/541; 222/556; 222/569; 220/359; 220/266; 220/269; 220/276; 220/82 R; 220/335; 156/69

[58] Field of Search ..... 264/23, 248; 156/69; 220/359

[56] References Cited

U.S. PATENT DOCUMENTS

| | | | |
|---|---|---|---|
| 677,466 | 7/1901 | Ortner | 220/335 X |
| 2,820,581 | 1/1958 | Makuta | 229/17 G X |
| 2,946,478 | 7/1960 | Clair, Jr. et al. | 220/270 |
| 3,481,515 | 12/1969 | Booth et al. | 220/270 X |
| 3,966,080 | 6/1976 | Bittel | 220/269 |
| 3,998,354 | 12/1976 | Song | 220/269 |
| 4,344,472 | 8/1982 | Larkin et al. | 220/266 |
| 4,363,420 | 12/1982 | Andrews | 220/359 X |
| 4,483,464 | 11/1984 | Nomura | 222/83 |
| 4,588,105 | 5/1986 | Schmitz et al. | 220/359 |

*Primary Examiner*—Robert J. Spar
*Assistant Examiner*—Jay I. Alexander
*Attorney, Agent, or Firm*—Parkhurst & Oliff

[57] ABSTRACT

A gable top carton for containing a beverage or like liquid product is disclosed which comprises a boxlike body having a closed bottom and a double sloping top. The top has an aperture defined in one of its sloping sides for pouring out the contained liquid. Closing this aperture is a plastic mouthpiece of one piece construction, which is fused to otherwise watertightly attached to the edge portion of the top around the aperture. The mouthpiece includes a lid having a pull tab protruding therefrom. The lid can be torn open upon exertion of a pull on the pull tab. Preferably, the pull tab is formed integral with a hook capable of engaging the ridge of the gable top when the lid is torn open, so that the lid may be held fully open as the liquid is poured out.

15 Claims, 27 Drawing Figures

SEALED GABLE TOP CARTON HAVING A MOUTHPIECE OF ONE PIECE MOLDING

BACKGROUND OF THE INVENTION

This invention deals generally with packages and more specifically with cartons to be filled with milk, juice or like beverages or other liquid products. Still more specifically, the invention is directed to a carton of the variety known as the gable top, having a double sloping top on a boxlike body, with a mouthpiece on one of the pair of sloping sides through which the contained liquid is discharged.

The long practiced method of discharging the liquid from a gable top carton has been to open the sealed ridge of the gable top by forcing its opposite sides away from each other. This practice is objectionable because of the considerable manual effort required. There is a hygienic problem, too, arising from the direct manipulation of the gable top from which the liquid is to be poured out.

In order to remedy these weaknesses, there has been suggested the use of a plastic mouthpiece, particularly in conjunction with cartons for liquors, soy sauce or the like. The mouthpiece is attached to one of the sloping sides of the gable top, so that the sealed ridge of the gable top need not be forced open for discharging the contained liquid. As heretofore constructed, however, the mouthpiece has been of two piece design, consisting essentially of a spout and a cap. The user has had first to remove the cap, then to proceed to tear off the closure on the spout.

Not only does the prior art mouthpiece of two piece construction demand considerable time and labor for opening, but also its fabrication is costly as it requires two different molds. The assemblage and mounting of the two piece mouthpiece in position on the gable top carton is also not so easy as could be desired.

SUMMARY OF THE INVENTION

The present invention solves all the noted problems heretofore encountered in the manufacture and use of gable top cartons by providing an entirely novel mouthpiece of one piece construction.

Stated briefly, the invention provides a gable top carton for containing a liquid product, comprising a boxlike body having a closed bottom, and a sealed gable top closing the top end of the boxlike body. The gable top has a pair of sloping sides one of which has an aperture defined therein. Watertightly closing this aperture is a mouthpiece of unitary construction including a lid with a pull tab projecting therefrom.

The mouthpiece of the foregoing construction can be a one piece injection molding of a plastic. In use, then, the lid can be torn open upon exertion of a pull on the pull tab. Preferably, the pull tab is formed integral with a hook which, when the lid is torn open, can engage the sealed ridge of the gable top for holding the lid open. After a desired quantity of the liquid is poured out, the hook may be disengaged from the ridge, and the lid may be closed and held closed until the next discharge from the carton.

Two basic configurations are possible within the broad teaching hereof. One has a flanged, substantially tubular spout, the outer end of which is closed by the tearable lid. The flange on the inner end of the spout is fused internally to the edge portion of the gable top defining the aperture. The other takes the form of a flat plate attached to the outside surface of the edge portion of the gable top. Either way, the lid is readily openable by pulling the pull tab, as then the lid is partly torn off the spout or the gable top. There is absolutely no need for touching those parts of the mouthpiece or the carton with which the liquid is to contact while being poured out. Furthermore, partly torn open and left hingedly coupled to the rest of the mouthpiece, the lid does not interfere with the discharge of the liquid as the hook on its distal end can be engaged with the ridge of the gable top to hold the lid fully open.

It will of course be seen that the mouthpiece of unitary construction in accordance with the invention is much easier to fabricate and less costly than that of two piece design in accordance with the prior art. The mounting of the mouthpiece in position on the gable top is also easy, as it is readily fusible, either thermally or ultrasonically, to the paperboard of which the carton is made.

The gable top carton constructed in accordance with the invention is suitable for as a package for milk, juice or the like. The cartons for such beverages are used up in comparatively short periods of time after being opened. They are usually not opened or closed too frequently, nor need they be held closed too tightly. The improved mouthpiece hereby proposed is highly suitable for use on such cartons, being simple in construction, inexpensive of manufacture, easy to use, and hygienically favorable.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
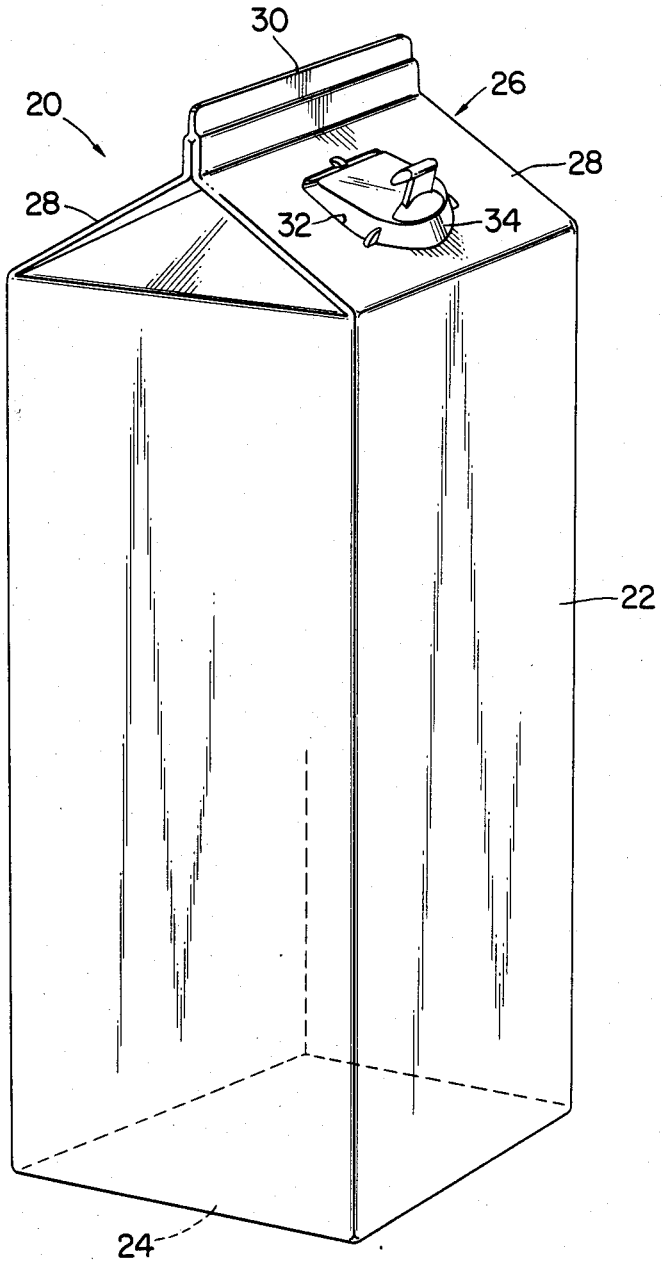
FIG. 1 is a perspective view of a preferred from of the gable top carton constructed in accordance with the invention.

The gable top carton in accordance with the invention is shown in its entirety in FIG. 1 of the attached drawings and therein generally designated 20. Typically made of paperboard, the carton 20 includes a boxlike body 22 having a conventionally closed bottom 24. At the top of the boxlike body 22 is a gable top 26 in the form of a double sloping roof, having a pair of oppositely sloping sides 28 with a sealed ridge 30 therebetween, as will be seen also from FIG. 2. One of the sloping sides 28 of the gable top 26 has an aperture 32 defined approximately centrally therein. The aperture 32 is watertightly closed by a mouthpiece 34 forming the gist of the present invention. The mouthpiece 34 is a one piece molding of polyethylene, polypropyrene, or like plastic material.

As illustrated in detail in FIGS. 2 through 6, the mouthpiece 34 has a substantially tubular spout 36 protruding outwardly from the aperture 32 in the gable top 26. The spout 36 is open at its inner end to the interior of the carton 20 and has an outer end closed by a tearable lid 38. A pull tab 40 extends outwardly or upwardly from the lid 38 and terminates in a hook 42 oriented toward the ridge 30 of the gable top 26.

Protruding from the pull tab 40, in a direction away from the gable top ridge 30, is a limit stop 44 engageable, when the lid 38 is reclosed after having been torn open, with the outer end of the spout 36 for preventing the lid from being depressed too far into the spout. The limit stop 44 is further effective to reinforce the pull tab 40 and to add to its rigidity. The limit stop 44 should not significantly protrude beyond the spout 36 in order to avoid interference with ultrasonic or thermal fusing means to be explained presently. Preferably, the limit stop 44 should be spaced a slight distance from the lid 38 in order to positively hold the lid reclosed after being torn open. This spacing may be approximately equal to the thickness of the lid 38.

The mouthpiece 34 is further formed to include a mounting flange 46 on the inner end of the spout 36. The mounting flange 46 is watertightly fused to the inside surface of the edge portion of the gable top 26 bounding the aperture 32.

Additionally, the mouthpiece 34 has as plurality of, typically three or four, retainer lugs 48 projecting laterally from the spout 36 in circumferentially spaced apart positions thereon. These retainer lugs are intended for use in holding the mouthpiece 34 in position on the gable top 26 preparatory to the fusing of the mounting flange 46 thereto. The retainer lugs 48 must be spaced from the mounting flange 46 a sufficient distance for engaging between themselves and the mounting flange the edge portion of the gable top 26 bounding the aperture 32. Generally, the spacing between each retainer lug 48 and mounting flange 46 should be from about four to five times the thickness of each side wall 28 of the gable top 26, so that the retainer lugs may easily travel beyond the edges of the gable top at the time of the mounting of the mouthpiece 34 thereon. This spacing may be from about 1.5 to 2.0 millimeters in practice. Should the spacing be less than the above specified range, the retainer lugs would fail to engage the gable top edges. If the spacing were greater than that range, on the other hand, then the mouthpiece might tilt on the gable top, making difficult the proper fusion of the mounting flange 46 thereto.

Figure 7:
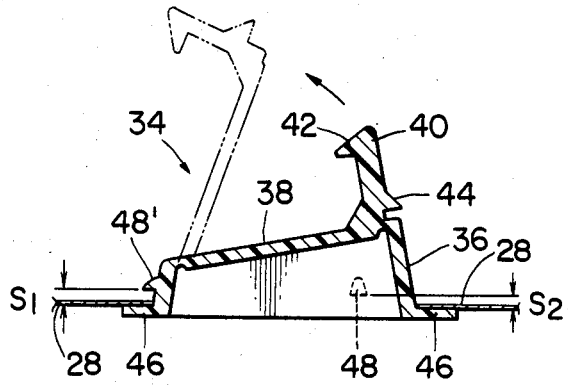
FIG. 7 is a view similar to FIG. 3 but showing a slight modification of the mouthpiece.

Preferably, and as illustrated in FIG. 7, the spacing S1 between the mounting flange 46 and that one (designated 48′ in this figure) of the retainer lugs 46 which is located at the blunt end (directed to the left in this figure) of the spout 36 should be greater than the spacing S2 between the mounting flange 46 and each of the other retainer lugs 46 arranged on the curved portions of the spout. Thus, for example, if the spacing S2 is 1.0 millimeter more than the thickness of the paperboard of which the carton 20 is made, the spacing S1 may be from 1.5 to 2.0 millimeters more than the thickness of the paperboard. This difference between the spacings S1 and S2 is preferred because the linear edge of the gable top 26, extending parallel to the gable top ridge 30 and opposed to the blunt end of the mouthpiece spout 36 is more pliant than the other gable top edges bounding the aperture 32, as will be later explained in more detail.

Figure 4:
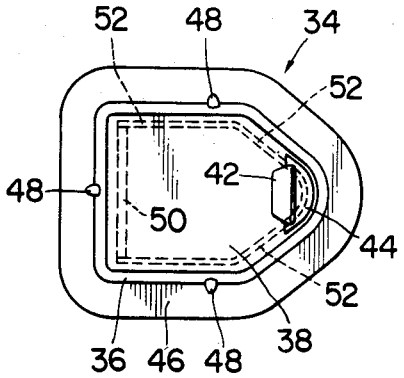
FIG. 4 is a top plan of the mouthpiece of the gable top carton of FIG. 1.
Figure 5:
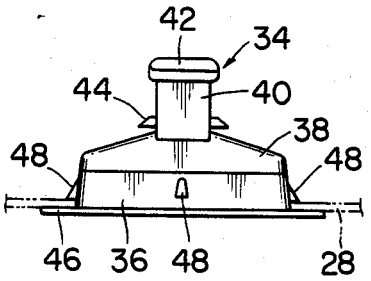
FIG. 5 is a rear elevation of the mouthpiece, as seen from the left hand side of FIGS. 3 and 4.
Figure 6:
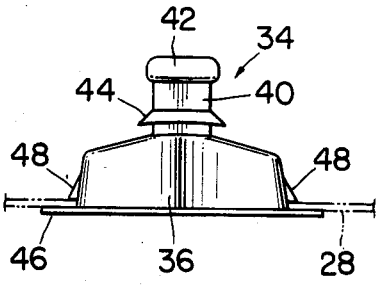
FIG. 6 is a front elevation of the mouthpiece, as seen from the right hand side of FIGS. 3 and 4.

As seen in a plan view as in FIG. 4, the spout 36, lid 38 and mounting flange 46 of the mouthpiece 34, as well as the gable top aperture 32 to be closed thereby, are all in the shape of a baseball home plate, with a blunt end directed toward the gable top ridge 30 and a relatively pointed (in fact, suitably rounded) end directed away therefrom.

Figure 3:
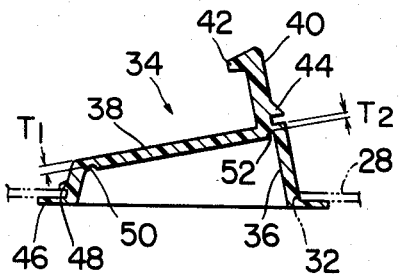
FIG. 3 is a longitudinal axial section through the mouthpiece of the gable top carton of FIG. 1.

It will also be observed from FIGS. 3 and 4 in particular that the tearable lid 38 is bounded by a linear first groove 50 cut internally in the blunt end of the closed top of the spout 36 and by a curved second groove 52 extending from the pointed or rounded end of the spout top to the opposite extremities of the first groove 50 along the pair of opposite sides of the spout top. The second groove 52 is so deep that the lid 38 can be torn along this second groove upon exertion of a pull on the pull tab 40. The first groove 50 is so shallow, however, that the lid 38 is not be to torn along this groove; instead, the first groove 50 serves to provide a hinge connection between the torn lid and the spout. Thus the lid 38 has a hinge end at the blunt end of the spount top and a tear end at the relatively rounded end thereof. The pull tab 40 is located at or adjacent the tear end of the lid 38.

The depths of the grooves 50 and 52 must of course be determined in relation to the thickness of the lid 38. The thickness T1, FIG. 3, of the spout top at the first groove 50 should be sufficiently great to withstand the repeated opening and closing of the lid 38 in the use of this gable top carton 20. A recommended range of the thickness T1 is from 0.4 to 0.5 millimeter. The thickness T2 of the spout top at the second groove 52, on the other hand, must be so small as to allow the ready tearing of the lid 38 but, nevertheless, must not be so small as to break as at the time of the mounting of the mouthpiece 34 on the gable top 26 or during the shipment of the carton 20. A recommended range of the thickness T2 is therefore from 0.2 to 0.3 millimeter.

The mouthpiece 34 of the above improved configuration is to be mounted in position on the carton 20 before the latter is formed into the gable topped boxlike shape of FIG. 1. The spout 36 of the mouthpiece 34 may be inserted into and through the aperture 32 in the gable top 26 from within until the retainer lugs 48 on the spout come out of the aperture and engage the edges of the gable top 26 between themselves and the mounting flange 46. Then the mounting flange 46 may be fused, either thermally or ultrasonically, to the inside surface of the edge portion of the gable top 26.

As has been stated in conjunction with FIG. 7, the spacing S1 between the mounting flange 46 and the retainer lug 48' at the blunt end of the spout 36 is from 0.5 to 1.0 millimeter more than the spacing S2 between the mounting flange and the other retainer lugs 48. Thus, even though the linear gable top edge to be engaged by the retainer lug 48' is significantly more pliant than the other gable top edges to be engaged by the retainer lugs 48, all the retainer lugs 48 and 48' will pass the aperture 32 concurrently, thereby simultaneously engaging the gable top edges between themselves and the mounting flange 46. The mounting of the mouthpiece 34 on the gable top 26 will be appreciably facilitated in this manner.

It will be seen that the spout 36 of the mouthpiece 34 tapers as it extends from its open inner end toward its closed outer end. This taper is intended to expedite the insertion of the spout 36 into and through the gable top aperture 32. Such a taper will also make it easier to fuse the mounting flange to the gable top 26, as the ultrasonic horn or thermal head will be more easily accessible to the outside surface of the gable top edge portion around the aperture 32.

The gable top carton 20 may be filled with a desired beverage or other liquid product following the mounting of the mouthpiece 34 in position thereon, and then has its gable top closed and sealed, as has been known heretofore.

The contained liquid is to be poured out by opening the lid 38 of the mouthpiece 34. The lid 38 may be opened by pulling the pull tab 40, or by tilting the pull tab toward the gable top ridge 30. Being augmented in rigidity by the limit stop 44, the pull tab 40 will transmit the full manual pressure thereon to the tear end of the lid 38. The concentrated application of the pull to this tear end of the lid 38 will first cause the breakage or tear of the spout top at that part of the deep groove 52 which is at the rear end of the lid. Then, upon sustained exertion of a relatively slight pull on the pull tab 40, the lid 38 will be torn along the deep groove 52, creating burrs on the opposed edges of the lid and the spout that have been torn apart. The tearing will cease at the opposite extremities of the shallow groove 50 at the hinge end of the lid 38.

Thus fully opened, the lid 38 is pivotable on the spout 36 at its hinge end. The lid 38 may be held fully open by engaging its hook 42 with the sealed ridge 30 of the gable top 26, as indicated by the phantom outline in FIG. 2. The liquid may now be poured out of the open spout 36 of the mouthpiece 34.

Following the discharge of a desired quantity of the liquid, the hook 42 may be disengaged from the gable top ridge 30, and the lid 38 may be reclosed by being pushed into the top of the spout 36. The previous tearing of the lid 38 has created burrs on its periphery and on the top edge of the spout 36. Consequently, upon reclosure of the lid 38, its peripheral burrs will engage with the burrs on the top edge of the spout, so that the lid will remain closed instead of being sprung open by some resiliency of its hinge end.

The user may exert a too much force on the lid 38 in reclosing it. Then the limit stop 44 on the pull tab 40 will butt on the top edge of the spout 36, preventing the lid 38 from being depressed too far into the spout. It has been mentioned that the limit stop 44 is slightly spaced upwardly or outwardly from the top of the spout 36. Accordingly, by being depressed into the spout 36 to an extent less than the spacing between the limit stop 44 and the top of the spout, the lid 38 will be more positively locked against accidental reopening by the interengaging burrs on the lid and the spout.

Figure 8:
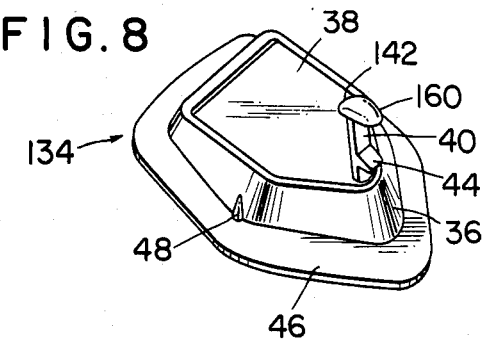
FIG. 8 is a perspective view of another example of mouthpiece suitable for use with the gable top carton of FIG. 1.
Figure 9:
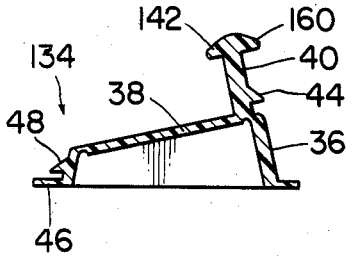
FIG. 9 is a longitudinal axial section through the mouthpiece of FIG. 8.
Figure 10:
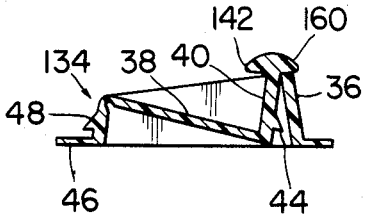
FIG. 10 is a view similar to FIG. 9 but explanatory of how the tearable lid of the FIG. 8 mouthpiece is prevented from being depressed too far into the spout.

In FIGS. 8, 9 and 10 is illustrated a slight modification of the above disclosed mouthpiece 34. Generally designated 134, this modified mouthpiece is to be mounted on the gable top 26 of the carton 20, FIGS. 1 and 2, in substitution for the mouthpiece 34.

The mouthpiece 134 differs from the mouthpiece 34 in having a pair of hooks 142 and 160 formed integrally on the distal end of the pull tab 40. The first hook 142 is substantially equivalent to the hook 42 of the preceding embodiment, being directed toward the sealed ridge of the gable top for engaging same when the lid is torn open. The second hook 160 is directed away from the gable top ridge and is adapted to engage the outer edge of the spout 36 when the lid, on being reclosed after having been torn open, is depressed too far into the spout. The other details of construction of the mouthpiece 134 can be identical with those set forth in connection with the preceding embodiment.

The pair of hooks 142 and 160 on the pull tab 40, projecting in the opposite directions from its top, serve in combination the additional purpose of affording a firmer grip on the pull tab than if only one hook is formed thereon as in the case of the mouthpiece 34. The user may pull the pull tab 40 by gripping both hooks 142 and 160 for opening the lid 38.

On being subsequently reclosed, the lid 38 may be forced into the spout 36 beyond the limit determined by the limit stop 44 on the pull tab 40. Then, as illustrated in FIG. 10, the second hook 160 will come into abutment against the top edge of the spout 36, preventing the lid from being depressed any further into the spout or into the carton. It will have been seen that the lid 38 of this mouthpiece 134 is dually equipped against undue depression into the spout 36.

Figure 11:
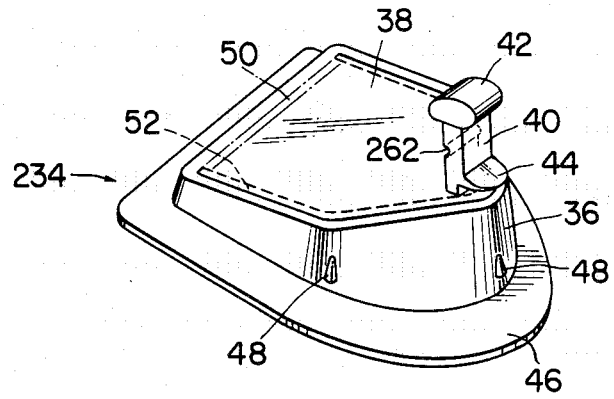
FIG. 11 is a perspective view of still another example of mouthpiece suitable for use with the gable top carton of FIG. 1.
Figure 12:
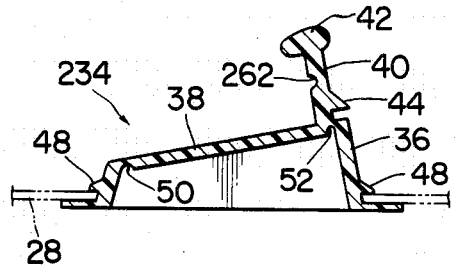
FIG. 12 is a longitudinal axial section through the mouthpiece of FIG. 11.
Figure 13:
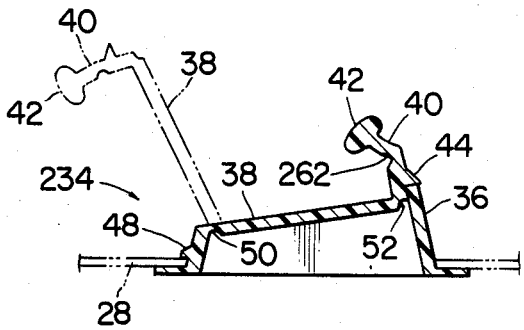
FIG. 13 is a view similar to FIG. 12 but explanatory of how the tearable lid of the FIG. 11 mouthpiece is prevented from being depressed too far into the spout.

FIGS. 11, 12 and 13 show still another mouthpiece 234 to be mounted on the gable top of the carton 20 in place of the mouthpiece 34. The mouthpiece 234 features an indentation 262 formed in the pull tab 40 at a point intermediate the hook 42 and the limit stop 44 thereon. The indentation 262 extends transversely of the pull tab 40, thus lessening its thickness at the point midway between hook 42 and limit stop 44. The mouthpiece 234 can be analogous in the other details of configuration with the first disclosed mouthpiece 34.

The indentation 262 is intended to make the pull tab 40 collapsible and hence to avoid undue depression of the lid 38 into the spout 36. The lid 38 may be reclosed, after having been torn open as indicated by the dashed lines in FIG. 13, by grasping the hooked top of the pull tab 40. When the torn lid 38 is reclosed with so much force, the limit stop 44 on the pull tab 40 will come into abutment against the top edge of the spout 36. If then the manual force on the pull tab 40 is still not released, then the pull tab will collapse, bending toward the gable top ridge as indicated by the arrow in FIG. 13. Both lid 38 and limit stop 44 will then be substantially relieved from the force on the pull tab 40 and so will stay in the positions of FIG. 13, with the lid properly closing the open top of the spout 36.

It will have been seen from the foregoing that the collapsible pull tab of this mouthpiece 234 can be thought of as an alternative to the dually hooked pull tab of the FIGS. 8 through 10 pull tab 134. Further, since the indentation 262 is meant to make the pull tab collapsible as above, it will be apparent that such an indentation or equivalent recess could be formed on either or both sides of the pull tab. The mouthpiece 234 with the collapsible pull tab 30 offers the advantage that it makes possible the use of a relatively soft plastic material.

Figure 2:
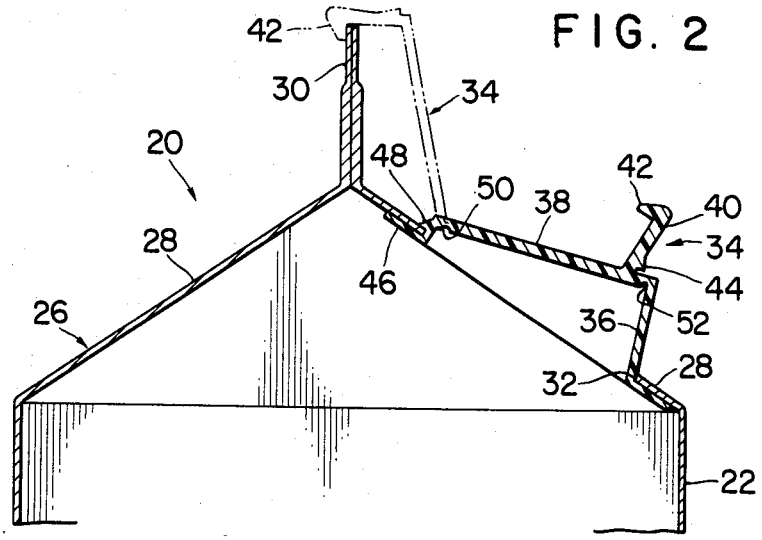
FIG. 2 is an enlarged, fragmentray vertical section through the gable top carton of FIG. 1, showing in particular the mouthpiece on the gable top of the carton.
Figure 14:
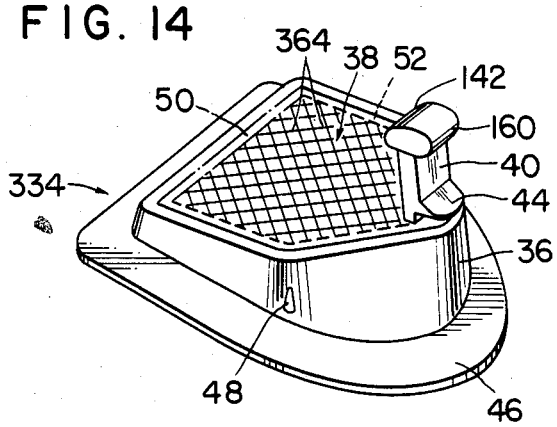
FIG. 14 is a perspective view of a further example of mouthpiece suitable for use with the gable top carton of FIG. 1.
Figure 15:
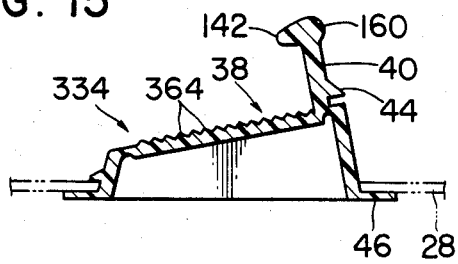
FIG. 15 is a longitudinal axial section through the mouthpiece of FIG. 14.

FIGS. 14 and 15 is an illustration of a further example of mouthpiece 334 in accordance with the invention, also suitable for use on the carton 20 of FIGS. 1 and 2 in place of the mouthpiece 34. The mouthpiece 334 has provisions for protecting the contained liquid against premature denaturation or perishing.

One of the requisities of packages for perishable products is the capability of maintaining them in a sound state for as long a period of time as possible. In cases where the carton mouthpiece in accordance with the invention is molded of polyethylene or like transparent or semitransparent plastic material, the light transmited therethrough might cause easy denaturation of the container liquid. In most countries the law dictates the range of plastics that can be used as food packages, and prohibits the use of additives for making them impenetrable to light.

Therefore, in the mouthpiece 334 of FIGS. 14 and 15, the outer surface of the lid 38 is knurled in a crisscross fashion, as designated by the numeral 364. The crisscross knurling 364 of the lid 38 is effective to diffusely reflect the rays of light falling thereon and hence to materially lessen the intensity of the rays penetrating the lid. The mouthpiece 334 is substantially akin in the other details of construction to the mouthpiece 34 of FIGS. 1 through 7.

Figure 16:
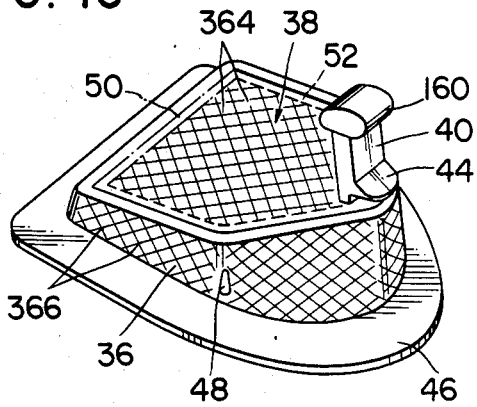
FIG. 16 is a perspective view of a slight modification of the FIG. 14 mouthpiece.

Of course, not only the outer surface but also the inner surface of the lid 38 could be knurled for preventing the passage of light to a still greater degree. Still further, as illustrated in FIG. 16, the spout 36 of the mouthpiece can also be knurled as at 366 for the same purpose. Such knurling of the mouthpiece is easy as the required surface or faces of the mold is knurled.

Figure 17:
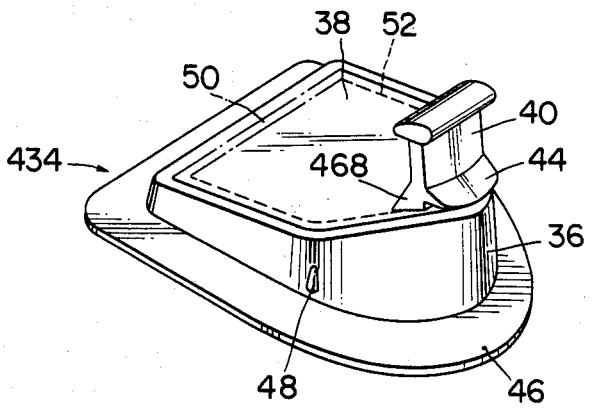
FIG. 17 is a perspective view of a further example of mouthpiece suitable for use with the gable top carton of FIG. 1.
Figure 18:
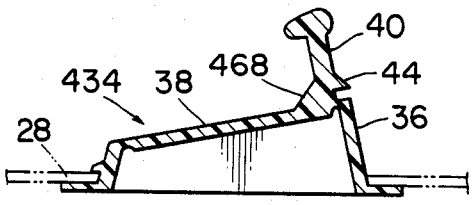
FIG. 18 is a longitudinal axial section through the mouthpiece of FIG. 17.
Figure 19:
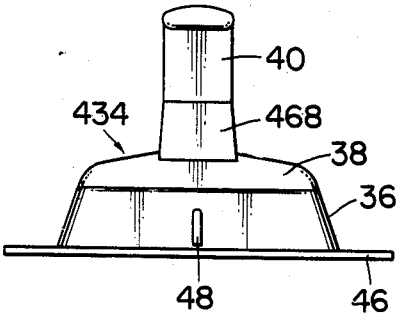
FIG. 19 is a rear elevation of the mouthpiece of FIG. 17, as seen from the left hand side of FIG. 18.

A further preferred example of mouthpiece 434 shown in FIGS. 17, 18 and 19 is formed to include a reinforcing portion 468 at the junction between the lid 38 and the pull tab 40. The reinforcing portion 468 extends throughout the width of the pull tab 40 and is located on that side of the pull tab which is directed toward the hinge end of the lid 38. The other details of construction of this mouthpiece 434 can be substantially as set forth in connection with FIGS. 1 through 7.

The reinforcing portion 468 serves not only to join the pull tab 40 to the lid 38 against the possibility of breakage but also to prevent the flexing of the pull tab when the lid 38 is reclosed after having been torn open. Should the pull tab 40 be too pliant, the limit stop 44 thereon might become directed upwardly when the lid 38 is being reclosed by pressing the pull tab, thus failing to engage the top edge of the spout 36 and allowing the lid to be depressed into the spout. The reinforcing portion 468 precludes this possiblity.

Figure 20:
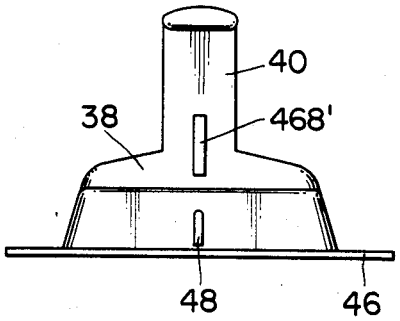
FIG. 20 is a view similar to FIG. 19 but showing a slight modification of the FIG. 17 mouthpiece.

In FIG. 20 is shown a modified reinforcing portion 468' in the form of a relatively thin rib, also formed at the junction between lid 38 and pull tab 40. This rib will perform the same functions as the reinforcing portion 468 of FIGS. 17 through 19. The provision of a pair of such ribs in spaced apart positions is undesirable, however, as dust or other foreign matter would accumulate therebetween.

Figure 21:
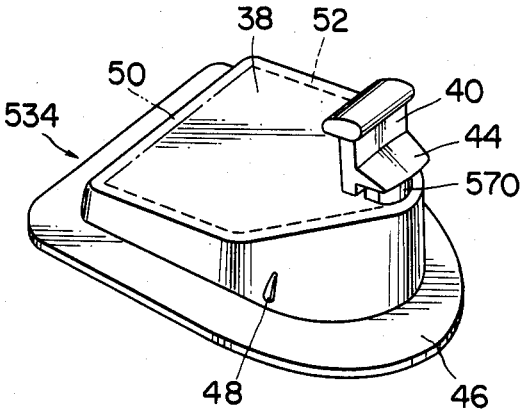
FIG. 21 is a perspective view of a further example of mouthpiece suitable for use with the gable top carton of FIG. 1.
Figure 22:
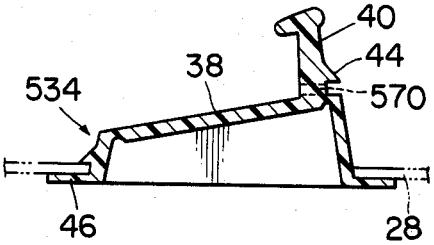
FIG. 22 is a longitudinal axial section through the mouthpiece of FIG. 21.
Figure 23:
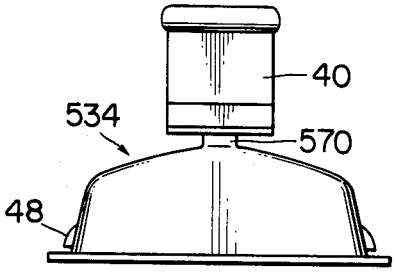
FIG. 23 is a front elevation of the mouthpiece of FIG. 21, as seen from the right hand side of FIG. 22.

In a further example of mouthpiece 534 shown in FIGS. 21, 22 and 23, the pull tab 40 is joined to the lid 38 via a constricted neck 570. The mouthpiece 534 is similar in the other details of construction to the mouthpiece 34 of FIGS. 1 through 7.

When the pull tab 40 is pulled for tearing open the lid 38, its constricted neck 570 serves to concentrate the pulling force on the lid 38. Consequently, the lid 38 is openable with a smaller force than in cases where the pull tab is joined directly to the lid as in all the foregoing embodiments.

Figure 24:
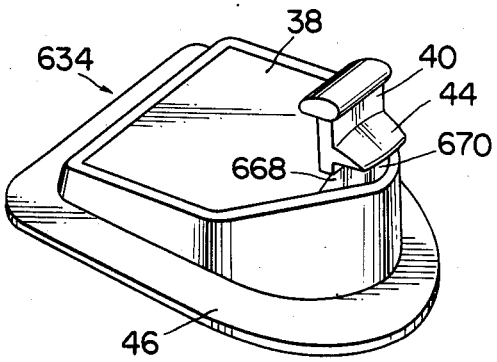
FIG. 24 is a perspective view of a further example of mouthpiece suitable for use with the gable top carton of FIG. 1, the mouthpiece combining the features of the FIGS. 17 and 21 mouthpieces.

A further example of mouthpiece 634 shown in FIG. 24 incorporates the features of both the mouthpiece 434 of FIGS. 17 through 19 and the mouthpiece 534 of FIGS. 21 and 23. The pull tab 40 is joined to the lid 38 via a constricted neck 670 which has a reinforcing portion 668 formed on its hinge end side. The advantage accruing from these features are as set forth already.

Figure 25:
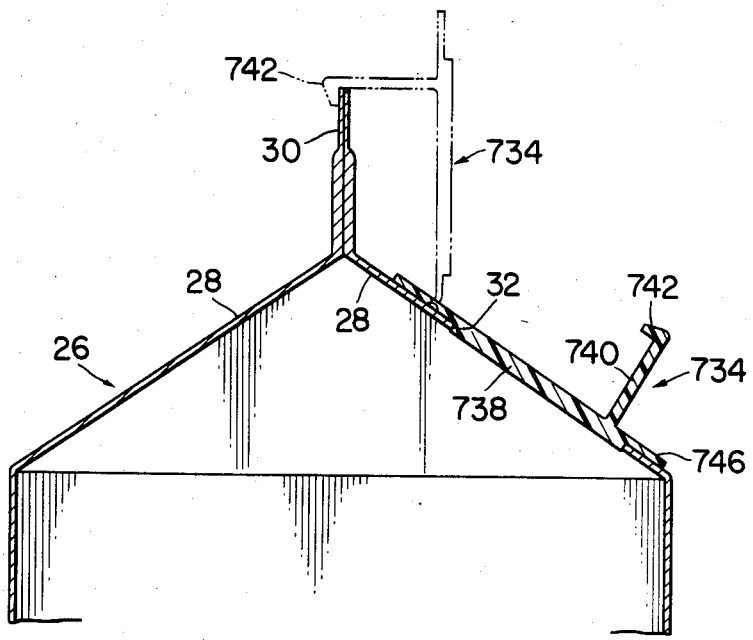
FIG. 25 is a fragmentary vertical section through a gable top carton incorpoating a different form of the mouthpiece in accordance with the invention.
Figure 26:
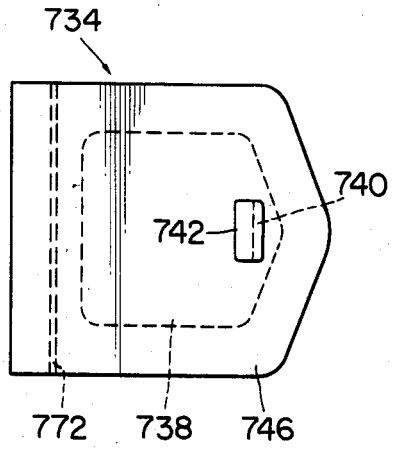
FIG. 26 is a top plan view of the mouthpiece of the gable top carton of FIG. 25.
Figure 27:
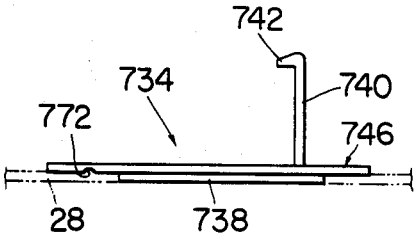
FIG. 27 is a side elevation of the mouthpiece of the gable top carton of FIG. 25.

FIGS. 25, 26 and 27 are illustrations of a still further example of mouthpiece 734 which differs from all the preceding embodiments in having no spout. The mouthpiece 734 is substantially in the form of a flat plate, comprising a relatively thick lid 738, complete with a pull tab 740 protruding outwardly therefrom and terminating in a hook 742, and a mounting flange 746 encircling the lid 738. Both lid 738 and mounting flange 746 are in the shape of a baseball home plate as seen in a plan view as in FIG. 26. The lid 738 fits in the aperture 32 of corresponding shape in one of the sloping sides 28 of the gable top 26, and the mounting flange 746 is fused to the adjoining edge portion of the gable top. The mounting flange 746 has a groove 772 formed in its inside surface, in the vicinity of its blunt end directed toward the gable top ridge 30. The groove 772 extends parallel to the gable top ridge 30. The pull tab 740 is disposed adjacent the relatively pointed end of the lid 738 directed away from the gable top ridge 30.

Thus, upon exertion of a pull on the pull tab 740, the mounting flange 746 will be torn from the gable top 26, first at its part in the immediate vicinity of the pull tab, until the tear proceeds to the groove 772. Then the lid 738, as well as part of the mounting flange 746 will blend at the groove 772. The pull tab 740 may then be hooked to the gable top ridge 30, as depicted by the dashed lines in FIG. 25, for pouring out the contained liquid through the gable top aperture 32.

For reclosing the gable top aperture 32, the hook 742 on the pull tab 740 may be disengaged from the gable top ridge 30, and the lid 738 together with part of the mounting flange 746 may be turned back until the lid 738 fits in the gable top aperture. The lid 738 will stably remain closed by virtue of its frictional engagement with the gable top edges defining the aperture 32, with the mounting flange 746 held against the gable top.

The gable top edges bounding the aperture 32 are not protected by this mouthpiece 734 after the lid 738 has been torn open. This will present no problem, however, particularly if the carton contains milk, juice or like beverage that is used up in a compartively short period of time. The other mouthpiece disclosed herein, which are all fused to the gable top from within, lend themselves for use with more penetrative liquid products such as liquors and soy sauce.

Notwithstanding the foregoing detailed disclosure, it is understood that the preferred embodiments set forth herein are by way of example only and not to impose limitations upon the invention, as a variety of modifications or alterations of such embodiments will readily occur to one skilled in the art. For instance, the mouthpiece need not be in the shape of a home plate as seen in a plan view but may be circular, rectangular, tiangular, hexagonal, and so forth. It will also be understood that, of the two grooves 50 and 52 defining the lid 38, the second groove 52 need not be cut in the inside surface of the closed outer end of the spout 36; instead, two such grooves having a total depth greater than the first groove 50 may be formed in register in both inside and outside surfaces of the outer end of the spout.

What is claimed is:

1. A gable top carton for containing a liquid product, comprising a boxlike body having a closed bottom, a sealed gable top closing a top end of the boxlike body and having a pair of oppositely sloping sides with a ridge formed therebetween, one of the sloping sides of the gable top having defined therein an aperture for pouring out the contained liquid product, and a mouthpiece of one piece plastic molding liquidtightly closing the aperture in one of the sloping sides of the gable top, said mouthpiece including a lid having a pull tab projecting therefrom and being formed to include a substantially tubular spout protruding outwardly from the aperture in the gable top, the spout being open at an inner end to the interior of the body and having an outer end closed by the lid, said lid having a hinge end located close to said ridge and a tear end located away from the ridge, said lid being defined by a relatively shallow, linear first groove cut in the hinge end of the lid and by a second groove of greater depth than the first groove extending from the tear end of the lid toward the opposite extremities of the first groove along a pair of opposite sides of the lid, said pull tab being formed adjacent the tear end of the lid, whereby upon exertion of a force on the pull tab, the lid is torn along the second groove, the first groove serving to provide a hinge connection between the torn lid and the spout, said mouthpiece being formed to include a mounting flange around the inner end of the spout, the flange being fused to an inside surface of an edge portion of the gable top defining the aperture therein, said mouthpiece being formed to include a plurality of retainer lugs protruding laterally from the spout at circumferentially spaced apart positions near the mounting flange for holding the mouthpiece in position on the gable top by engaging said edge portion between said lugs and the mounting flange preparatory to the fusing of the flange to the gable top.

2. A gable top carton as set forth in claim 1, and wherein the pull tab of the mouthpiece is formed to include a hook capable of engaging the ridge of the gable top when the lid is torn open, for holding the lid open.

3. A gable top carton as set forth in claim 1, wherein the aperture in the gable top and the spout and lid of the mouthpiece are all in the shape of a home plate as seen in a plan view, each having a blunt end directed toward the ridge of the gable top and a pointed end directed away therefrom.

4. A gable top carton as set forth in claim 1, wherein the spout of the mouthpiece tapers as it extends from its inner end toward its outer end.

5. A gable top carton as set forth in claim 1, wherein the retainer lugs on the spout are spaced from the flange a distance from about four to five times the thickness of each side wall of the gable top.

6. A gable top carton as set forth in claim 1, wherein the aperture in the gable top has one end extending linearly and parallel to a ridge between the pair of sloping sides of the gable top, wherein one of the retainer lugs is so located on the spout as to engage the edge of the gable top bounding the linear end of the aperture, and wherein said one retainer lug is spaced from the flange to a greater extent than are the other retainer lugs.

7. A gable top carton as set forth in claim 1, wherein the pull tab of the mouthpiece is formed to include a limit stop protruding therefrom for engaging the outer end of the spout when the lid is reclosed after having been torn open, thereby preventing the lid from being depressed too far into the spout.

8. A gable top carton as set forth in claim 7, wherein the limit stop of the pull tab of the mouthpiece is spaced from the lid.

9. A gable top carton as set forth in claim 7, wherein the pull tab of the mouthpiece is formed to include first and second hooks on its end away from the lid, the first hook being directed toward the ridge of the gable top for engaging same when the lid is partly torn apart from the spout, the second hook being directed away from the ridge and being effective to engage the outer end of the spout when the lid, on being reclosed after having been torn open, is depressed into the spout beyond the limit determined by the limit stop on the pull tab.

10. A gable top carton as set forth in claim 1, wherein the mouthpiece is formed to include a reinforcing portion at the junction between the lid and the pull tab.

11. A gable top carton as set forth in claim 1, wherein the pull tab is located on the tear end of the lid so that the lid is tearable from the tear end toward the hinge end so as to be left hingedly joined to the tubular body at the hinge end, and wherein the mouthpiece is formed to include a reinforcing portion at the junction between the lid and the pull tab, the reinforcing portion being located on that side of the pull tab which is directed toward the hinge end of the lid.

12. A gable top carton as set forth in claim 1, wherein the pull tab of the mouthpiece is joined to the lid via a constricted neck.

13. A gable top carton as set forth in claim 12, wherein the mouthpiece is formed to include a reinforcing portion at the junction between the lid and the constricted neck of the pull tab.

14. A gable top carton for containing a liquid product, comprising a boxlike body having a closed bottom, a sealed gable top closing a top end of the boxlike body and having a pair of oppositely sloping sides with a ridge formed therebetween, one of the sloping sides of the gable top having defined therein an aperture for pouring out the contained liquid product, and a mouthpiece of one piece molding liquidtightly closing the aperture in one of the sloping sides of the gable top, said mouthpiece including a lid having a pull tab projecting therefrom and being formed to include a substantially tubular spout protruding outwardly from the aperture in the gable top, the spout being open at an inner end to the interior of the body and having an outer end closed by the lid, said lid having a hinge end located close to said ridge and a tear end located away from the ridge, said lid being defined by a relatively shallow, linear first groove cut in the hinge end of the lid and by a second groove of greater depth than the first groove extending from the tear end of the lid toward the opposite extremities of the first groove along a pair of opposite sides of the lid, said pull tab being formed adjacent the tear end of the lid, whereby upon exertion of a force on the pull tab, the lid is torn along the second groove, the first groove serving to provide a hinge connection between the torn lid and the spout, said pull tab of the mouthpiece being formed to include a limit stop protruding therefrom for engaging the outer end of the spout when the lid is reclosed after having been torn open, thereby preventing the lid from being depressed too far into the spout, said pull tab having formed therein an indentation which is located farther away from the lid than is the limit stop, whereby when the lid is reclosed by pushing the pull tab after having been torn open, the pull tab is collapsible at the indentation and so is prevented from being depressed into the spout beyond the limit determined by the limit stop on the pull tab.

15. A gable top carton for containing a liquid product, comprising a boxlike body having a closed bottom, a sealed gable top closing a top end of the boxlike body and having a pair of oppositely sloping sides with a ridge formed therebetween, one of the sloping sides of the gable top having defined therein an aperture for pouring out the contained liquid product, and a mouthpiece of one piece plastic molding liquidtightly closing the aperture in one of the sloping sides of the gable top, said mouthpiece including a lid having a pull tab projecting therefrom and being formed to include a substantially tubular spout protruding outwardly from the aperture in the gable top, the spout being open at an inner end to the interior of the body and having an outer end closed by the lid, said lid having a hinge end located close to said ridge and a tear end located away from the ridge, said lid being defined by a relatively shallow, linear first groove cut in the hinge end of the lid and by a second groove of greater depth than the first groove extending from the tear end of the lid toward the opposite extremities of the first groove along a pair of opposite sides of the lid, said pull tab being formed adjacent the tear end of the lid, whereby upon exertion of a force on the pull tab, the lid is torn along the second groove, the first groove serving to provide a hinge connection between the torn lid and the spout, said lid of the mouthpiece being knurled so as to diffusely reflect incident rays of light.

* * * * *